US007124482B2

(12) United States Patent
Kim

(10) Patent No.: US 7,124,482 B2
(45) Date of Patent: Oct. 24, 2006

(54) FIXING DEVICE FOR LACES

(76) Inventor: Hyun-Soo Kim, 592, Saengcheol-Ri, Saengrim-Myeon, Kimhae, Kyeongnam-Do (KR) 621-823

( * ) Notice: Subject to any disclaimer, the term of this patent is extended or adjusted under 35 U.S.C. 154(b) by 0 days.

(21) Appl. No.: 11/200,269

(22) Filed: Aug. 9, 2005

(65) Prior Publication Data

US 2006/0080814 A1 Apr. 20, 2006

Related U.S. Application Data

(63) Continuation of application No. PCT/KR2003/001131, filed on Jun. 9, 2003.

(30) Foreign Application Priority Data

Apr. 30, 2003 (KR) ..... 20-2003-0013537

(51) Int. Cl.
*A43C 7/00* (2006.01)
*A44B 21/00* (2006.01)

(52) U.S. Cl. ..... 24/712.1; 24/712.5; 24/115 R

(58) Field of Classification Search ..... 24/712.1, 24/712.2, 712.5, 712.7, 712, 115 A, 136 R, 24/115 R
See application file for complete search history.

(56) References Cited

U.S. PATENT DOCUMENTS 4,790,048 A 12/1988 Arnt ..... 24/117
5,182,838 A 2/1993 Stenner ..... 24/712.7
5,903,959 A * 5/1999 Leonardi ..... 24/712.1
6,029,323 A 2/2000 Dickie et al. ..... 24/712.6
6,718,602 B1 * 4/2004 Chang ..... 24/712.1
2005/0172463 A1 * 8/2005 Rolla ..... 24/712.1

OTHER PUBLICATIONS

International Search Report dated Jan. 16, 2004.

* cited by examiner

*Primary Examiner*—Robert J. Sandy
(74) *Attorney, Agent, or Firm*—St. Onge Steward Johnston & Reens, LLC

(57) ABSTRACT

Disclosed is a fixing device for laces used in footwear, clothes, bags, and so on, and that can be configured in an extremely simple manner while maintaining the lace at a tightly fixed state when in use, without having any slip, thereby ensuring convenience of use. The present invention provides a fixing device for a lace that includes fixing plates that are extended from both sides of a curved plate thereof, so as to be applied to clothes, bags, etc., and means that is formed on elastic fixing projection pieces and a protruded part corresponding to the elastic fixing projection pieces, for preventing the lace from being moved to or deviated from one side of the elastic fixing projection pieces.

5 Claims, 4 Drawing Sheets

FIXING DEVICE FOR LACES

This application is a continuation of pending International Patent Application No. PCT/KR2003/001131 filed Jun. 9, 2003, which designates the United States and claims priority of Korean Application No. 20-2003-0013537 filed Apr. 30, 2003.

FIELD OF THE INVENTION

The present invention relates to a fixing device for laces which is used in footwear, clothes, bags, and so on, and which can be configured in an extremely simple manner while maintaining the lace at a tightly fixed state when in use, without having any slip, thereby ensuring convenience of use.

BACKGROUND ART

Various devices for tightly fixing laces have been conventionally devised and put into practical use. However, they are configured in a complicated manner, which of course causes their production cost to be greatly high.

Accordingly, the inventor has proposed a novel lace-fixing device that is made in a relatively simple manner, and effectively fixes laces, which is disclosed in Korean Utility Model Application No. 1993-05516.

In the prior art, as shown in FIGS. 1 to 3, a fixing device 20 is provided with an elastically supported plate 21 having coupling holes 23 on both sides of a fastening hole 22 formed on the central portion thereof, and bent portions 24 bent inwardly from edges of both end sides thereof; and a curved plate 25 having a protruded part 28 through which a lace coupling hole 27 is formed to pass, on both sides of a fastening hole 26 formed on the central portion thereof. The elastically supported plate 21 is also provided with elastic fixing projection pieces 30 that are protruded from one side of the coupling holes 23. The elastically supported plate 21 is adapted to be cladded on the top side portion of the curved plate 25, in such a manner that the bent parts 24 of the elastically supported plate 21 are locked onto both sides of the curved plate 25, so that the elastic fixing projection pieces 30 can press a lace 29 that is passed through the lace coupling hole 27 formed on the curved plate 25 toward the protruded part 28, thereby enabling the lace 29 to be maintained at a tightly fixed state.

The lace fixing device 20 is easily applied to footwear, because it does not need any additional fixing means, but it fails to be applied to wearing apparel like clothes or bags. When the lace 29 is moved to one sides of the elastic fixing projection pieces 30 during the process of pressing the lace 20 against the protruded part 28 by means of the elastic fixing projection pieces 30, there is a possibility that the elastic fixing projection pieces 30 are raised or the lace 29 is deviated from both sides of the elastic fixing projection pieces 30, which keeps the lace 29 from being appropriately fixed.

DISCLOSURE OF INVENTION

Therefore, the present invention has been made in view of the above-described problems, and it is an object of the present invention to provide a fixing device for a lace that includes fixing plates that are extended from both sides of a curved plate thereof, so as to be applied to clothes, bags, etc., and means that is formed on elastic fixing projection pieces and a protruded part corresponding to the elastic fixing projection pieces, for preventing the lace from being moved to or deviated from one side of the elastic fixing projection pieces.

BRIEF DESCRIPTION OF DRAWINGS

Further objects and advantages of the invention can be more fully understood from the following detailed description taken in conjunction with the accompanying drawings, in which.

DETAILED DESCRIPTION OF THE PREFERRED EMBODIMENTS

Now, an explanation of the preferred embodiment of the present invention will be given with reference to accompanying drawings.

Figure 1:
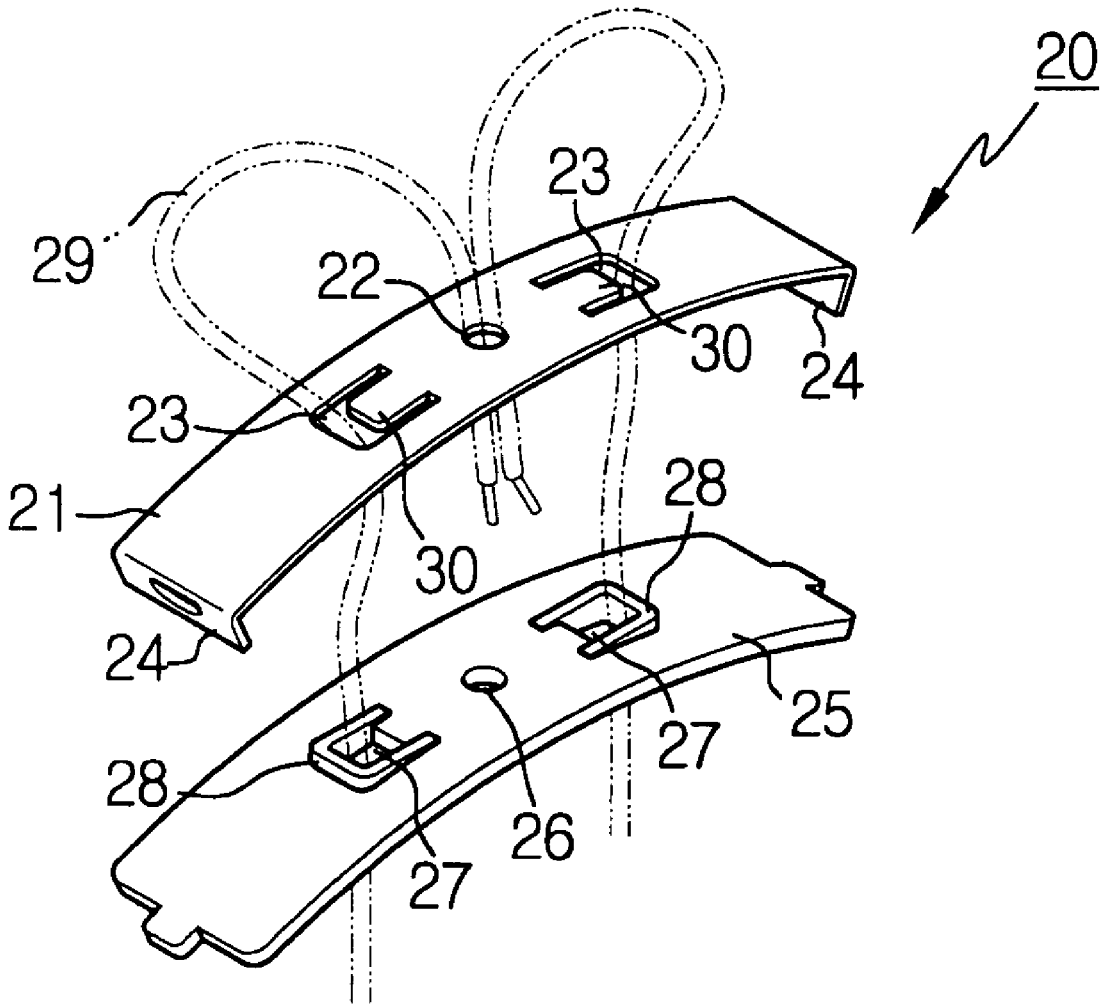
FIG. 1 is an exploded perspective view showing an example of a fixing device for a lace according to the prior art.
Figure 2:
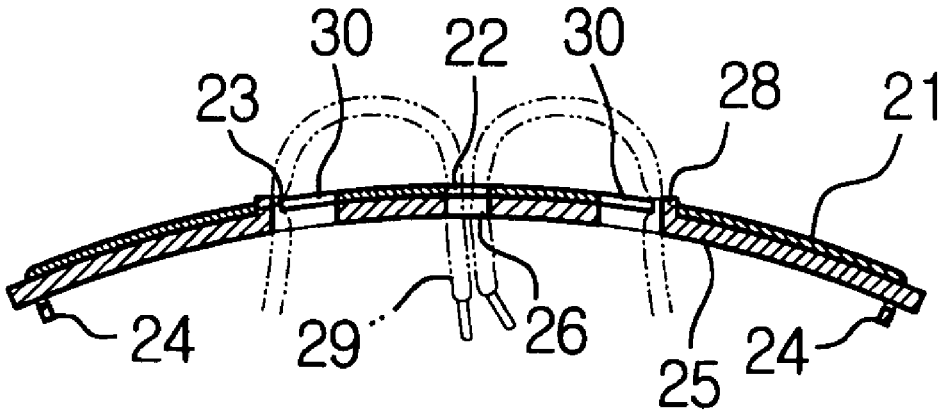
FIG. 2 is a sectional view of the fixing device in FIG. 1.
Figure 3:
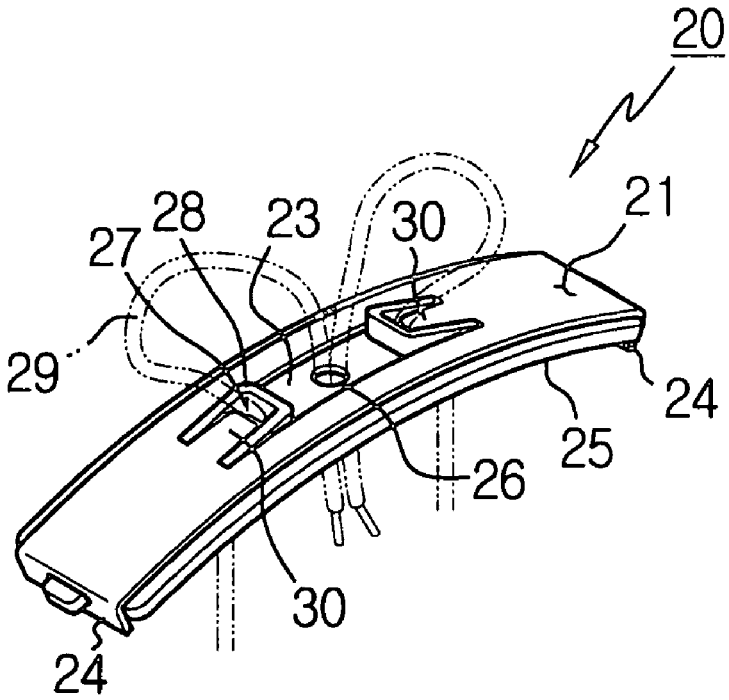
FIG. 3 is a perspective view showing another example of the fixing device according to the prior art.
Figure 4:
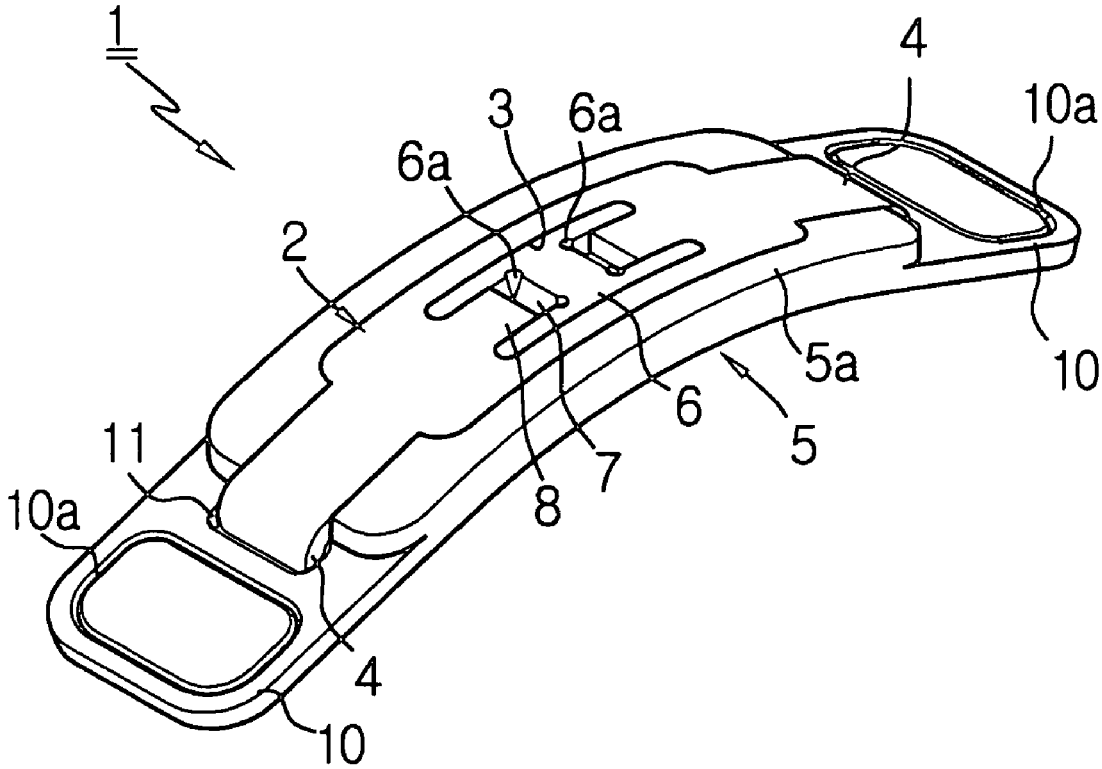
FIG. 4 is a perspective view showing a fixing device for a lace according to a preferred embodiment of the present invention.
Figure 5:
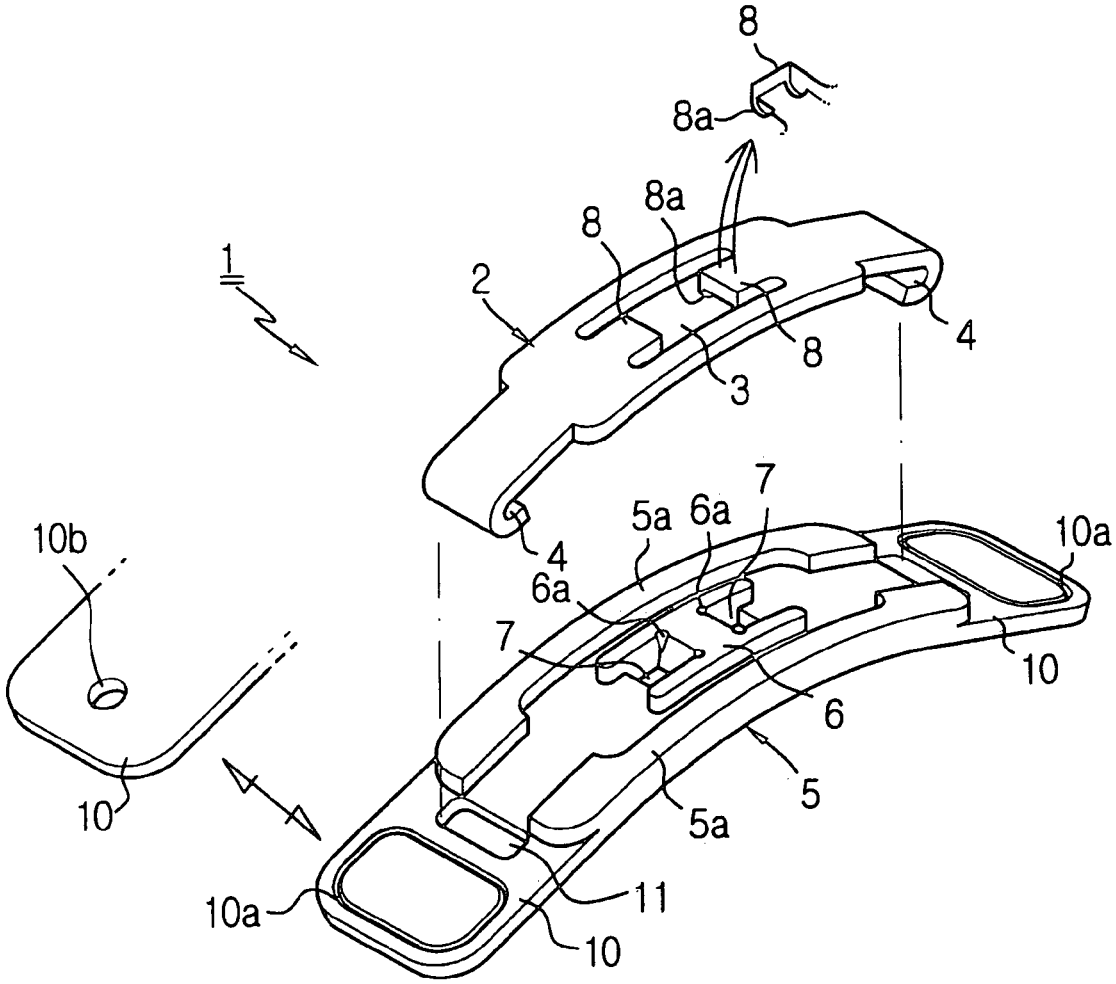
FIG. 5 is an exploded perspective view of the fixing device in FIG. 4.
Figure 6:
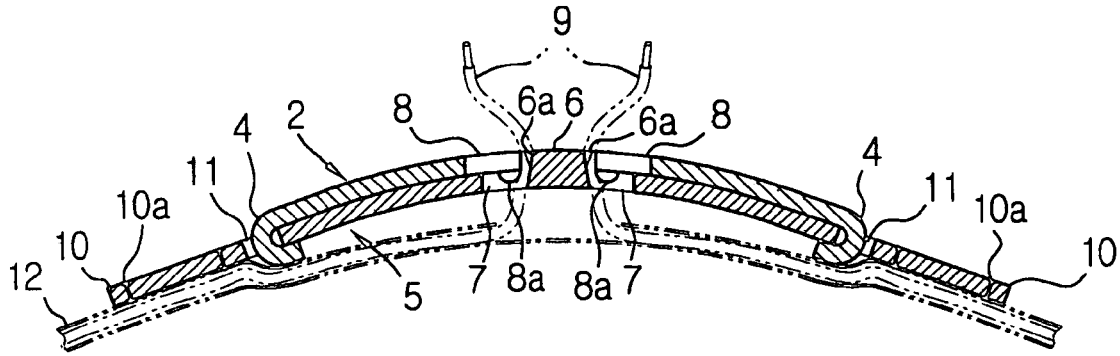
FIG. 6 is a sectional view showing a use example of the fixing device according to the present invention, wherein the lace is tightened.
Figure 7:
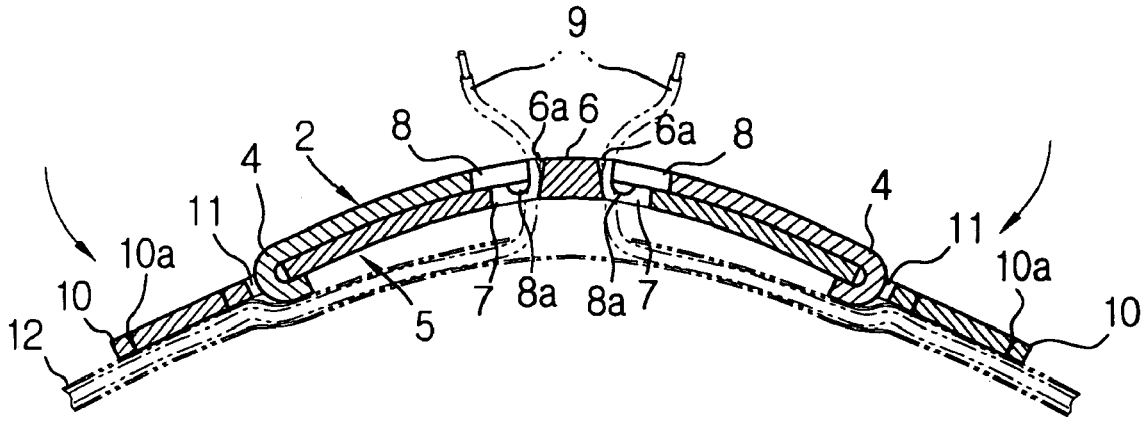
FIG. 7 is a sectional view showing another use example according to the present invention, wherein the lace is loosened.

FIG. 4 is a perspective view showing a fixing device for a lace according to a preferred embodiment of the present invention, FIG. 5 is an exploded perspective view of the fixing device in FIG. 4, FIG. 6 is a sectional view showing a use example of the fixing device according to the present invention, wherein the lace is tightened, and FIG. 7 is a sectional view showing another use example according to the present invention, wherein the lace is loosened.

According to the preferred embodiment of the present invention, a fixing device 1 is provided with an elastically supported plate 2 made of hard synthetic resin, the elastically supported plate 2 having a coupling hole 3 formed on the central portion thereof and bent parts 4 bent inwardly from edges of both end sides thereof; and a curved plate 5 made of soft synthetic resin and having a protruded part 6 through which lace coupling holes 7 are formed to pass, on both sides thereof. The elastically supported plate 2 is fixedly cladded on the top side portion of the curved plate 5 in such a manner as that the protruded part 6 of the curved plate 5 is snap-fitted into the coupling hole 3 of the elastically supported plate 2. The elastically supported plate 2 is also provided with elastic fixing projection pieces 8 that are protruded from both sides of the coupling hole 3 in such a manner as to be opposite to each other, so that the elastic fixing projection pieces 8 can press a lace 9 that is passed through the lace coupling holes 7 formed on the curved plate 5 toward the protruded part 6, thereby enabling the lace 9 to be maintained at a tightly fixed state.

According to the present invention, the curved plate 5 is provided with fixing plates 10 that are formed integrally with both sides thereof and with bent part coupling holes 11 that are formed at the boundaries between the curved plate 5 and each of the fixing plates 10, for snap-fitting the bent parts 4 of the elastically supported plate 2 thereto. The curved plate is further provided with projected parts 5*a* that are formed on both longitudinal edge sides thereof, to substantially corresponds to the length of the elastically supported plate (2), so that the elastically supported plate 2 is embeddedly coupled to the curved plate 5 in such a manner that the top surfaces of the elastically supported plate 2 and the projected parts 5*a* are flush with each other. Each of the fixing plates 10 is provided with a sewing groove 10*a* or a fixing hole 10*b* that is formed thereon for the purpose of being fixedly sewn or riveted on attached articles 12 like clothes or bags.

The coupling hole 3 of the elastically supported plate 2 is formed on the central portion of the elastically supported plate 2 in such a manner as that the elastic fixing projection pieces 8 face each other within the coupling hole 3 in a shape of "I", and a protruded part 6 and lace coupling holes 7 are formed on the central portion of the curved plate 5 to correspond to the coupling hole 3 and the elastic fixing projection pieces 8, respectively.

The elastic fixing projection pieces 8 further includes a pair of protrusions 8*a* formed on both sides of the front end of the bottom portion thereof, so that the lace 9 threaded into each of the lace coupling holes 7 can be guided to the central portion of each of the elastic fixing projection pieces 8. The protruded part 6 further includes two pair of reentrant grooves 6*a* formed on the central portion thereof so as to correspond to both side edges of the end portion of each of the elastic fixing projection pieces 8, thereby preventing the lace 9 from being moved to and deviated from one sides of the elastic fixing projection pieces 8, when the lace 9 is pulled.

The lace fixing device of the invention configured as above is applied in such a manner that the fixing plates 10 integrally formed with both sides of the curved plate 5 are fixedly sewn or riveted on the attached articles 12 like clothes, bags, and footwear, and the elastically supported plate 2 is then coupled to the top side of the curved plate 5, as shown in FIGS. 6 and 7.

When it is desired to tightly fix the lace 9, once the laces 9 fitted between the protruded part 6 and each of the elastic fixing projection pieces 8 through the lace coupling holes 7 formed on the curved plate 5 is pulled at free end portions thereof, as shown in FIG. 6, they are drawn by a predetermined length to the outside through the protruded part 6 and each of the elastic fixing projection pieces 8. At this time, when the lace 9 is let loosened, the elastic fixing projection pieces are depressed toward the protruded part 6, such that the lace 9 becomes tightened.

In this case, conventionally, there is a possibility that the lace 9 may be moved to or deviated from one side between the protruded part 6 and each of the elastic fixing projection pieces 8 in accordance with a direction in which the lace 9 is pulled. According to the invention, however, a pair of protrusions 8*a* are formed on both sides of the front end of the bottom portion of each of the elastic fixing projection pieces 8, and two pair of reentrant grooves 6*a* are formed on the central portion of the protruded part 6 to be opposite to each other, thereby avoiding bias of the lace 9 toward one side of each of the elastic fixing projection pieces 8, during the pulling of the lace 9.

When it is desired to loose the lace 9 that has been once fixed, the fixing device 1 for the lace is depressed at the edges of both sides thereof, as shown in FIG. 7. Then, since the fixing device 1 itself is curved, it becomes bent inwardly. At this time, the elastic fixing projection pieces 8 are maintained at a depressed state, but the elastically supported plate 2 and the curved plate 5 are bent. As a result, the protruded part 6 and each of the elastic fixing projection pieces 8 becomes spaced apart from each other to form a space therebetween. In this case, when the lace 9 is pulled at the lower portion thereof, it is easily loosened.

INDUSTRIAL APPLICABILITY

As set forth in the foregoing, the fixing device 1 for the lace according to the present invention is applied to attached articles 12 like clothes, bags, footwear and the like for the purpose of tightly fixing the lace 9. Further, the fixing device 1 of the present invention has advantages in that it is made in a substantially simple manner and at a relatively low cost and can maintain the lace at a tightly fixed state when in use, without having any slip. In addition, when the elastically supported plate 2 and the curved plate 5 have different colors, the fixing device 1 of the present invention improves the quality of its external appearance.

In the meanwhile, in the case where the invention is applied to the outer covers of various gloves for the use in winter sports, when the lace 9 is pulled to be tightly fixed, the fixing device 1 allows the outer covers of the gloves to be depressed, thereby improving heating capability of the gloves and preventing foreign substances from entering the inside thereof.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

What is claimed is:

1. A fixing device for a lace, the fixing device comprising: an elastically supported plate made of hard synthetic resin, the elastically supported plate having a coupling hole formed on a central portion thereof and bent parts bent inwardly from edges of both end sides thereof; and a curved plate made of soft synthetic resin and having a protruded part through which lace coupling holes are formed to pass, on both sides thereof, wherein the elastically supported plate is fixedly cladded on a top side portion of the curved plate in such a manner that the protruded part of the curved plate is snap-fitted into the coupling hole of the elastically supported plate, and elastic fixing projection pieces are protruded from both sides of the coupling hole in such a manner as to be opposite to each other, so that the elastic fixing projection pieces can press a lace that is passed through the lace coupling holes formed on the curved plate toward the protruded part, thereby enabling the lace to be maintained at a tightly fixed state, characterized in that, the curved plate includes fixing plates formed integrally with both sides thereof, bent part coupling holes formed at boundaries between the curved plate and each of the fixing plates, for snap-fitting the bent parts of the elastically supported plate thereto, and projected parts formed on both longitudinal edge sides thereof, to substantially correspond to the length of the elastically supported plate, whereby the elastically supported plate is embeddedly coupled to the curved plate in such a manner that the top surfaces of the elastically supported plate and the projected parts are flush with each other.

2. The fixing device for a lace according to claim 1, wherein the coupling hole of the elastically supported plate is formed on the central portion of the elastically supported plate in such a manner that the elastic fixing projection pieces face each other within the coupling hole in a shape of "I", and a protruded part and lace coupling holes are formed on the central portion of the curved plate to correspond to the coupling hole and the elastic fixing projection pieces, respectively.

3. The fixing device according to claim 1, wherein the elastic fixing projection pieces further includes a pair of protrusions formed on both sides of the front end of the bottom portion thereof, so that the lace fitted into each of the lace coupling holes can be guided to the central portion of each of the elastic fixing projection pieces.

4. The fixing device according to claim 1, wherein the protruded part further includes two pair of reentrant grooves formed on the central portion thereof so as to correspond to both side edges of the end portion of each of the elastic fixing projection pieces, thereby preventing the lace from being moved to and deviated from one side of each of the elastic fixing projection pieces, when the lace is pulled.

5. The fixing device according to claim 1, wherein each of the fixing plates has a sewing groove or a fixing hole formed thereon so as to allow attachment to articles like clothes or bags.

* * * * *